US010385599B2

(12) United States Patent
Nakanishi

(10) Patent No.: US 10,385,599 B2
(45) Date of Patent: Aug. 20, 2019

(54) SPIRAL BALANCE DEVICE

(71) Applicant: NAKANISHI INDUSTRIAL CO., LTD., Tokyo (JP)

(72) Inventor: Yoshikazu Nakanishi, Tokyo (JP)

(73) Assignee: NAKANISHI INDUSTRIAL CO., LTD. (JP)

( * ) Notice: Subject to any disclaimer, the term of this patent is extended or adjusted under 35 U.S.C. 154(b) by 0 days.

(21) Appl. No.: 16/025,714

(22) Filed: Jul. 2, 2018

(65) Prior Publication Data

US 2019/0032385 A1 Jan. 31, 2019

(30) Foreign Application Priority Data

Jul. 27, 2017 (JP) ..... 2017-145651

(51) Int. Cl.
*E05F 1/00* (2006.01)
*E05D 13/00* (2006.01)

(52) U.S. Cl.
CPC .... *E05D 13/1253* (2013.01); *E05Y 2900/148* (2013.01)

(58) Field of Classification Search
CPC ..... Y10T 16/64; Y10T 16/6298; E05D 5/02; E05D 13/10; E05D 13/12; E05D 13/1253; E05D 13/1276; E05D 13/1284; E05D 13/1292; E05D 15/165; E05Y 2900/148; E06B 3/44; E06B 3/4407; E06B 3/4415
See application file for complete search history.

(56) References Cited

U.S. PATENT DOCUMENTS 2,041,646 A * 5/1936 Larson ..... E05D 13/1253 16/197
2,365,156 A * 12/1944 Viehweger ..... E05D 13/1253 16/197
2,477,069 A 7/1949 Larson ..... 16/197
2,598,560 A * 5/1952 Kenyon ..... E05D 13/123 16/193
2,604,655 A * 7/1952 Peremi ..... E05D 13/1253 16/197
2,776,447 A * 1/1957 Addicks ..... E05D 13/1253 16/197

(Continued)

FOREIGN PATENT DOCUMENTS

GB 764546 A * 12/1956 ..... E05D 13/1253
GB 2379237 A * 3/2003 ..... E05D 13/1207
GB 2463985 A * 4/2010 ..... E05D 13/1207

*Primary Examiner* — Chuck Y Mah
(74) *Attorney, Agent, or Firm* — Adams & Wilks

(57) ABSTRACT

A spiral balance device for sash windows has a pipe inside of which extends a spiral rod having a screw section. A lower end of the spiral rod extends through a slot in a coupling rotatably disposed inside the lower end of the pipe and projects from the lower end of the pipe. A torsion spring has an upper end fixed near the upper end of the pipe and a lower end fixed to the coupling. A fixing member is fixed within the upper end of the pipe, and an adjustment member rotatably disposed below the fixing member engages with the upper end of the spiral rod. A ratchet mechanism disposed between the fixing member and adjustment member allows rotation of the adjustment member in a direction of winding the torsion spring and prevents rotation of the adjustment member in a direction of unwinding the torsion spring.

15 Claims, 5 Drawing Sheets

(56) References Cited

U.S. PATENT DOCUMENTS

| | | | | | |
|---|---|---|---|---|---|
| 2,792,588 | A * | 5/1957 | Gency | E05D 13/1253 | 16/197 |
| 2,825,089 | A * | 3/1958 | Larson | E05D 13/1253 | 16/197 |
| 2,826,781 | A * | 3/1958 | Gency | E05D 13/08 | 16/197 |
| 2,890,480 | A * | 6/1959 | Mahlon | E05D 13/1269 | 16/197 |
| 5,383,303 | A * | 1/1995 | Nakanishi | E05D 13/1253 | 49/175 |
| 6,948,215 | B2 * | 9/2005 | Malek | E05D 13/1207 | 16/197 |
| 6,978,515 | B2 * | 12/2005 | Noguchi | E05D 13/1253 | 16/193 |
| 7,574,772 | B2 * | 8/2009 | Wellman | E05D 13/1207 | 16/193 |
| 8,146,204 | B2 * | 4/2012 | Lucci | E05D 13/1207 | 16/193 |
| 8,302,258 | B2 * | 11/2012 | Lucci | E05D 13/1207 | 16/193 |
| 2008/0235905 | A1 * | 10/2008 | Lucci | E05D 13/1207 | 16/197 |

* cited by examiner

SPIRAL BALANCE DEVICE

FIELD OF THE INVENTION

The present invention relates to a spiral balance device by which opening and closing of a sash window can be done easily and the window can be stopped at any desired position.

BACKGROUND OF THE INVENTION

A sash window requires considerable effort in an opening and closing operation due to the weight of window and may sometimes move down from the state at rest by its own weight. To prevent such situation, for example, U.S. Pat. No. 2,477,069 describes a spiral balance device in which a balanced load is generated corresponding to the weight of the window when the window is opened and closed to maintain balance with the weight of the window. This spiral balance device has a spiral rod and a torsion spring within a pipe. When the window is moved downwardly, the spiral rod moves downwardly within the pipe together with the window and winds a torsion spring, and the restoring force of the wound torsion spring functions to pull up the spiral rod and maintain balance with the weight of the window. In more detail, the spiral balance device has a pipe; an anchor provided within the upper end of the pipe; a coupling which is journaled at the lower end of the pipe and has, at its center, a slot through which a spiral rod is inserted; a torsion spring is housed within the pipe, the upper end of which is fixed to the anchor and the lower end of which is fixed to the coupling; and a spiral rod inserted through the interior of the torsion spring and having a screw section which is formed in a longitudinal direction and the lower end of the spiral rod projecting downwardly out of the pipe. Generally, such spiral balance devices are produced by balance manufacturers and delivered to window manufacturers in such a state that the torsion spring is not wound, namely, no tension is applied to the torsion spring.

The window manufacturers fit the spiral balance device received from the balance manufacturers into a window frame, fix the upper end of the pipe to the window frame, and then directly connect the lower end of the spiral rod downwardly projecting from the lower end of the pipe to a connecting member fixed to the window, to fabricate a sash window. Or, the window manufacturers may connect the lower end of the spiral rod to a slide block slidably fitted to a window frame and connect the spiral rod to a connecting member of the window via the slide block, to fabricate the sash window. During this fabrication operation, the window manufacturers are required to preliminarily wind the torsion spring so that the torsion spring has a spring tension corresponding to the window weight to maintain the window at the elevated and opened position. For this purpose, it is necessary to grip and rotate the spiral rod projecting from the lower end of the pipe. In this operation, since the pipe is fixed to the window frame and the operation site is narrow, a special tool is necessarily used, and it is difficult to securely grip the lower end of the spiral rod and appropriately rotate it.

Further, since the restoring force of the wound torsion spring always functions to rotate the spiral rod in a reverse direction, it is not easy to further rotate the spiral rod against the restoring force. In addition, when the spring is wound, the spring tension varies by the function of spring-back and is therefore unstable immediately after winding the spring. If the spring is set in the window under such condition that the spring tension is not yet stabilized, the expected spring tension cannot be generated, and it is likely that the window cannot be held securely. For this reason, the spiral balance device is usually left to stand for a few days until the spring tension is stabilized with the lapse of enough time, and thereafter correctly adjusted. Otherwise, the fabricated window cannot be shipped. Accordingly, for conventional spiral balance devices, it takes a long time to complete final fabrication.

The spiral balance device described in the above US patent is constituted in such a way that the spring torsion can be adjusted after fabrication, but when the spring is incorporated into the window the first time, it is required to preliminarily wind the torsion spring. The adjusting device described in the above US patent is constituted in such a way that one end of the torsion spring is fixed to a notched rotation tube, and a pin is inserted into the rotation tube to make it possible to rotate the tube and wind the spring. To enable the rotation tube to turn, it is necessary to dispose a hole provided in the rotation tube, a pin to be inserted into the hole, and an opening section disposed on a fixed tube through which the pin is inserted into a pipe. To dispose these constituting parts, operation steps are required to cut away a part of the rotation tube, pipe, fixed tube and the like to form a hole or an opening. Accordingly, the conventional balance adjustment device has a complicated structure and its production is cumbersome.

US Patent Publication No. 2008/235905 describes a spiral balance device which can be delivered from balance manufactures to window manufacturers in such a state that tension is preliminarily applied to a torsion spring. In the spiral balance device described in this publication, a spiral rod is urged by a torsion spring so that the spiral rod can be pulled toward the upper end of a pipe. Into an anchor disposed at the upper end of the pipe, a pre-tensioning insert is installed with which the upper end of the spiral rod is engaged. By this structure, rotation of the spiral rod is usually stopped by the pre-tensioning insert. When the torsion spring is further wound, the spiral rod is pulled toward the lower portion of the pipe to disengage the upper end of the spiral rod from the pre-tensioning insert. By this operation, the spiral rod is placed into a state that it can rotate relative to the pre-tensioning insert. Then, the spiral rod is rotated to wind the torsion spring.

In the spiral balance device described in the above US publication, when the torsion spring is further wound, a force tending to rotate the spiral rod in a reverse direction is exerted on the spiral rod by the restoring force of the preliminarily wound torsion spring. Therefore, to further wind the torsion spring, it is required to firmly hold the lower end of the spiral rod and turn it so as to overcome the restoring force tending to rotate the spiral rod in a reverse direction. Such an operation needs powerful force and is cumbersome. As mentioned above, to rotate the spiral rod, it is necessary to withdraw the spiral rod a predetermined length out of the lower end of the pipe and maintain such a state that the pre-tensioning insert and the upper end of the spiral rod are disengaged. However, when the torsion spring is further wound, a strong force to pull the spiral rod toward the inside of the pipe is gradually exerted. For this reason, the spiral rod is pulled up and easily engaged with the pre-tensioning insert, whereby it becomes further difficult to rotate the spiral rod in such a state that it is withdrawn out of the pipe and stays at the predetermined position.

As mentioned above, when the torsion spring is further wound, it is required to withdraw the spiral rod against the pulling force exerted by the torsion spring and to insert the spiral rod and make the upper end thereof engage with the pre-tensioning insert at the upper position of the pipe against the restoring force tending to rotate the spiral rod in a reverse direction. As explained above, in the spiral balance device described in the above US publication, it is necessary to conduct an operation of withdrawing the spiral rod in an axial direction and elevate it. In addition, it is difficult from the outside of the pipe to grasp the extent of winding, i.e., how much the spring has been wound, and therefore the state of adjustment cannot be clearly confirmed.

SUMMARY OF THE INVENTION

It is an object of the present invention to provide a spiral balance device in which a spiral rod is transferred in an axial direction with the movement of a window to wind a torsion spring, and by the restoring force of the wound torsion spring, balance with the weight of the window is maintained, wherein spiral balance manufacturers can deliver their products to window manufacturers in such a state that the torsion spring is preliminarily wound, i.e., pre-tension is applied.

It is another object of the present invention to provide a spiral balance device in which when the torsion spring is wound, it is not necessary to withdraw the spiral rod out of the pipe, the winding operation is simple, and the extent of winding can be easily ascertained.

The above and other objects of the present invention are achieved by a spiral balance device having a pipe; a spiral rod having a first terminal housed in the pipe, a second terminal which projects from a lower end of the pipe, and an axially extending screw section between the first and second terminals; and a coupling rotatably disposed near the lower end of the pipe and having a slot through which the spiral rod is inserted. A torsion spring extends axially inside the pipe and has a lower end fixed to the coupling and an upper end fixed near an upper end of the pipe. A fixing member is fixed within the upper end of the pipe, and an adjustment member is rotatably disposed inside the pipe below the fixing member and has an engagement projection engageable with the first terminal of the spiral rod. A ratchet mechanism is disposed between the fixing member and the adjustment member and which, relative to the fixing member, allows the adjustment member to rotate in a direction of winding the torsion spring and prevents the adjustment member from rotating in a direction of unwinding the torsion spring. The above problems prevalent in the prior art can be solved by the spiral balance device of the present invention.

According to the spiral balance device of the present invention, ratchet teeth of the ratchet mechanism are disposed facing each other on the lower face of the fixing member and the upper face of the adjustment member. Each ratchet tooth has a slant face slanting in the circumferential direction of the pipe and a stepped portion at the end portion of the slant face. The adjustment member has a spring-retaining projection inserted through an axial hole at the center of the fixing member, and a stopper spring is disposed around the spring-retaining projection for urging the adjustment member toward the fixing member side.

In a substantially similar way to conventional spiral balance devices, the spiral balance device of the present invention comprises a pipe having an upper end and a lower end, a spiral rod housed in the pipe and having a screw section, and a coupling which has a slot though which the spiral rod is inserted and which is rotatably disposed at the lower end of the pipe. The lower end of a torsion spring is fixed to the coupling and the upper end of the torsion spring is fixed to an anchor disposed at the upper end of the pipe.

However, unlike the conventional spiral balance devices, in the present invention a fixing member is fixed to the upper end of the pipe and an adjustment member is rotatably disposed below the fixing member and has, at its inner face, an engagement projection engageable with the first terminal of the spiral rod. Between the fixing member and the adjustment member, a ratchet mechanism is disposed which, relative to the fixing member, allows the adjustment member to rotate in a direction of winding the torsion spring and prevents the adjustment member from rotating in a direction of unwinding the torsion spring. By this structure, without withdrawing the spiral rod out of the lower end of the pipe, the adjustment member can be rotated via the spiral rod in a direction of winding the torsion spring. Therefore, by turning the spiral rod in a direction of winding the torsion spring, the torsion spring can be wound via the coupling. At that time, since it is not necessary to withdraw the spiral rod out of the pipe, it is no longer required to take the extent of withdrawing the spiral rod into account unlike the device described in US Patent Publication No. 2008/235905. Since the adjustment member does not rotate in the direction of unwinding the torsion spring, the reverse rotation of the spiral rod is constrained. Accordingly, when the spiral rod is further rotated, the spring restoring force exerted on the spiral rod is small and the rotation operation thereof can be made easily.

The ratchet teeth of the ratchet mechanism are disposed facing each other on the lower face of the fixing member and the upper face of the adjustment member. Each ratchet tooth has a slant face slanting toward the circumferential direction and a stepped portion positioned at the end portion of the slant face. The spring-retaining projection on the adjustment member is inserted through an axial hole disposed at the center of the fixing member. By the stopper spring disposed around the spring-retaining projection, the adjustment member is biased upwardly toward the fixing member. By this structure, a rotation sound is generated when the adjustment member turns. Namely, when the adjustment member turns to tighten the torsion spring, at first, the upper face of the adjustment member is separated from the lower face of the fixing member by the slant faces of the ratchet teeth. Then, when the stepped portions of the ratchet teeth face each other, the adjustment member is moved rapidly toward the fixing member by the stopper spring, and the upper face of the adjustment member forcibly abuts on the lower face of the fixing member. When the abutment member strikes the fixing member, a "snap" or "click" abutment sound is generated. The abutment sound is generated each time the adjustment member abuts on the fixing member, and therefore the number of abutment sounds indicates the number of incremental rotations of the adjustment member and the extent of winding of the torsion spring.

As described above, the balance manufacturer preliminarily winds the torsion spring a predetermined number of rotations to apply pre-tension and lets it to stand for a predetermined period of time to relieve the change due to spring-back, and then provides the window manufacturer with the product. As mentioned above, since the devices can be shipped under such state that a predetermined pre-tension is applied to the torsion spring, the window manufacture can immediately incorporate the delivered spiral balance device into a window frame to complete the fabrication of the window, whereby the time of fabrication of the window can be shortened.

DETAILED DESCRIPTION OF THE INVENTION

Figure 1:
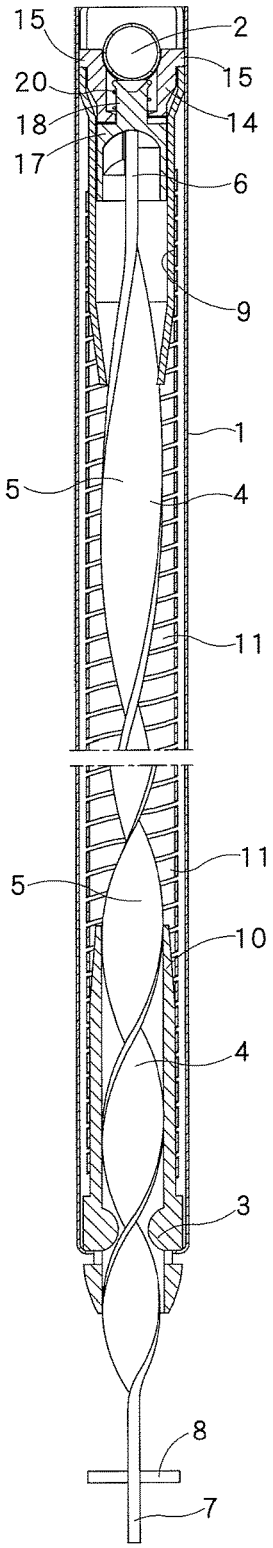
FIG. 1 is a cross-sectional view of a spiral balance device according to one embodiment of the present invention.

FIG. 1 shows an example of a spiral balance device according to one embodiment of the present invention to be applied to a sash window (not shown). As conventionally known, a pipe 1 configured to be housed in a window frame (not shown) of a sash window opens at its upper end and lower end and is fixed to the window frame by inserting a mounting screw (not shown) into a mounting hole 2 disposed near the upper end. At the lower end portion of the pipe 1, a coupling 3 is rotatably installed. Within the pipe 1, a spiral rod 5 having a screw section 4 formed in an axial direction is housed, and the spiral rod 5 extends in an axial direction through a slot at the central portion of the coupling 3. A first terminal or end portion 6 of the spiral rod 5 extends to near the upper end of the pipe 1, and a second terminal or end portion 7 of the spiral rod projects downwardly from the lower end of the pipe 1 and has a pin 8 attached thereto for connection with a window (not shown).

Figure 2:
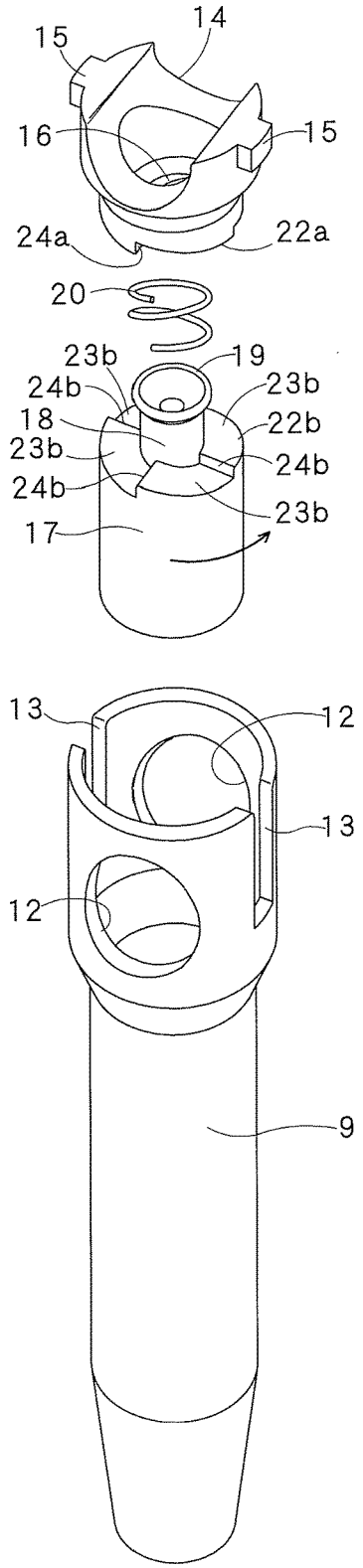
FIG. 2 is a disassembled perspective view of an upper end portion with the pipe omitted.
Figure 3:
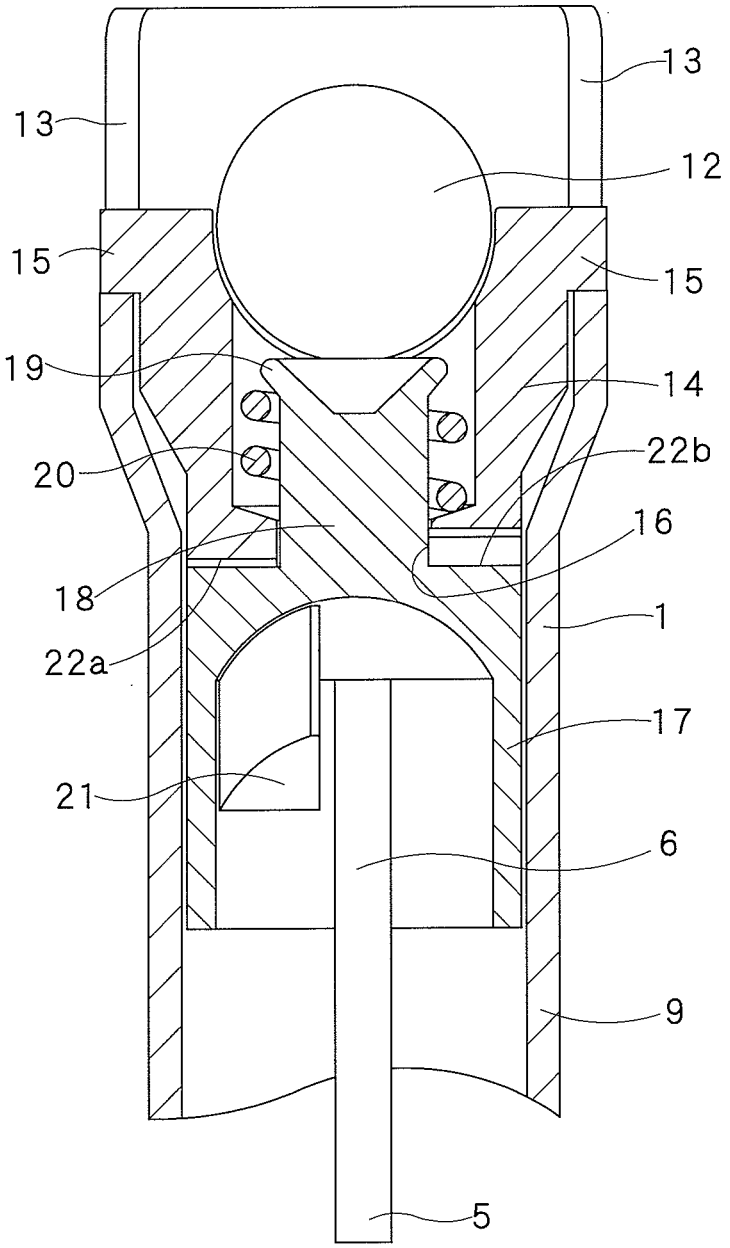
FIG. 3 is an enlarged cross-sectional view of an anchor portion.

A cylindrical anchor 9 is inserted into the upper section of the pipe 1 and fixed to the window frame by the mounting screw (not shown). As shown in FIGS. 2 and 3, the anchor 9 has a large diameter portion and a small diameter portion formed below the large diameter portion. A torsion spring 11 extends axially inside the pipe 1. The upper end portion of the torsion spring 11 is fixed to the small diameter portion of the anchor 9 and the lower end portion of the torsion spring is fixed to a cylindrical sleeve 10 which is connected to the coupling 3. In the disclosed embodiment, the coupling 3 and the sleeve 10 are formed as one piece though they may be formed as separate pieces connected together to form an integrated structure. As conventionally known, the lower end of the spiral rod 5 is fixed to a connecting member (not shown) fixed to the window. As also conventionally known, a slide block (not shown) may be fitted to a window frame, and the lower end of the spiral rod may be connected to the slide block to connect the spiral rod to the window via the slide block. Here, the pipe may be connected to the window side and the spiral rod may be connected to the window frame side.

With reference to FIG. 2 and FIG. 3, the large diameter portion of the anchor 9 is provided with engagement holes 12 aligned with the mounting hole 2 of the pipe 1 and slits 13 which extend in an axial direction and open at their upper end. When the mounting hole 2 is formed in the pipe 1, a part of the wall of the pipe is pressed inwardly, forming a burr (not shown) that engages with the edge of the engagement hole 12. By this structure, the anchor 9 is fixedly held in the pipe 1 and will not be detached from the pipe. A fixing member 14 is inserted into the large diameter portion of the anchor 9, and outward projections 15 formed at both sides of the fixing member engage with the slits 13 to prevent rotation of the anchor 9 relative to the fixing member 14. An axial hole 16 opening in the axial direction of the pipe 1 is formed at the center of the fixing member 14.

Into the small diameter portion of the anchor 9 which extends downwardly from the fixing member 14, an adjustment member 17 is rotatably disposed. The adjustment member 17 has a cylindrical body having an outer diameter slightly smaller than the inner diameter of the small diameter portion of the anchor 9, and at its upper face, a spring-retaining projection 18 projects upwardly into the axial hole 16 of the fixing member 14. At the front end of the projection 18, an enlarged-head section 19 is disposed. A stopper spring 20 is disposed around the projection and urges the adjustment member 17 to be pressed against the underside of the fixing member 14. The stopper spring 20 is inserted between the enlarged-head section 19 and the upper edge of the axial hole 16 of the fixing member 14, and in FIG. 3, it urges or pulls the adjustment member 17 upwardly. If desired, the stopper spring may be eliminated since the spiral rod 5 is urged to the side of the first terminal 6 by the spring force of the torsion spring 11 and presses the adjustment member 17 upwardly.

Figure 5:
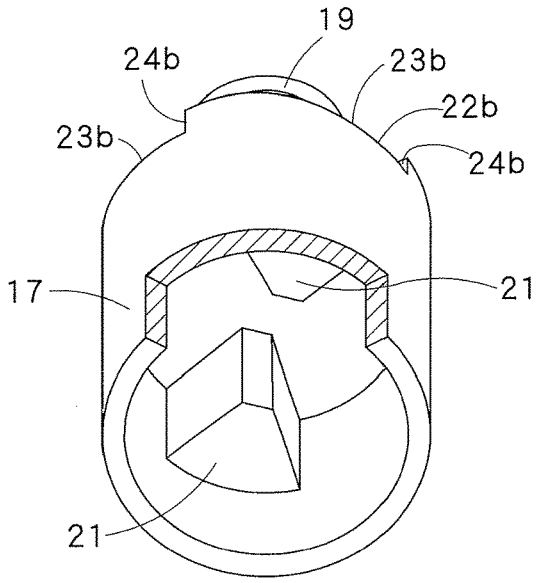
FIG. 5 is a partly cutaway perspective view of an adjustment member as seen from the bottom.
Figure 6:
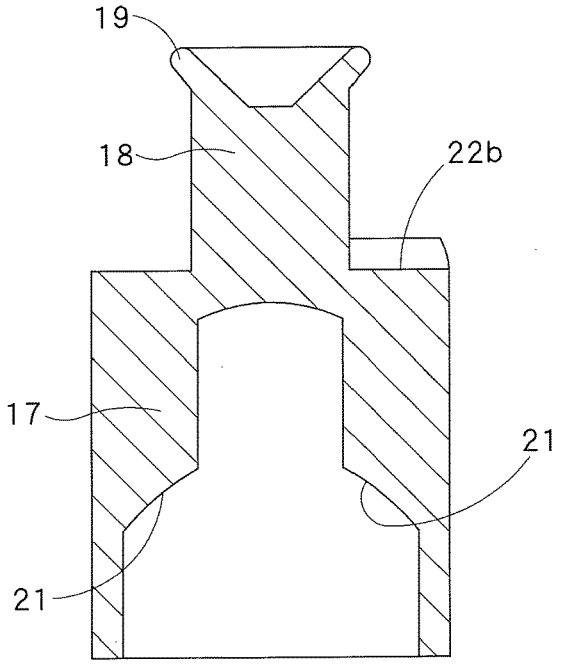
FIG. 6 is a cross-sectional view of an adjustment member.
Figure 7:
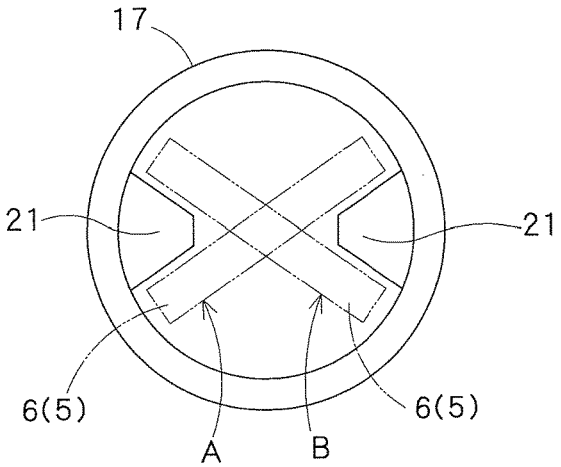
FIG. 7 is a bottom view of the adjustment member.

As shown in FIGS. 5-7, engagement projections 21 are disposed at the inner face of the adjustment member 17. In this embodiment, the engagement projections 21 comprise two generally triangular protrusions facing each other and each projecting inward from the inner face of the adjustment member 17. The lower face of each engagement projection 21 slants toward the central portion of the adjustment member as shown in FIG. 6, and both side faces slant in a generally truncated triangular shape when viewed from the bottom as shown in FIG. 7. When the first terminal 6 of the spiral rod 5 is inserted into the inside of the adjustment member 17, the torsion spring 11 urges the first terminal 6 into engagement with one of the side faces of the engagement projections 21. For example, if the torsion spring 11 is wound by turning the spiral rod 5 in the counterclockwise direction, the restoring force of the torsion spring urges the spiral rod clockwise to position A. To wind the torsion spring 11, the spiral rod 5 is turned counterclockwise to position B where it engages the other side faces of the engagement projections 21 after which continued rotation of the spiral rod rotates the adjusted member 17. When the torsion spring 11 is wound to the desired pre-tension and rotation of the spiral rod 5 ceases, the restoring force of the torsion spring turns the spiral rod clockwise to position A. As explained above, without withdrawing the spiral rod 5 out of the pipe 1, the adjustment member 17 can be rotated to tighten the torsion spring 11 by simply gripping and rotating the second terminal 7 of the spiral rod 5 that protrudes from the lower end of the pipe.

Figure 4:
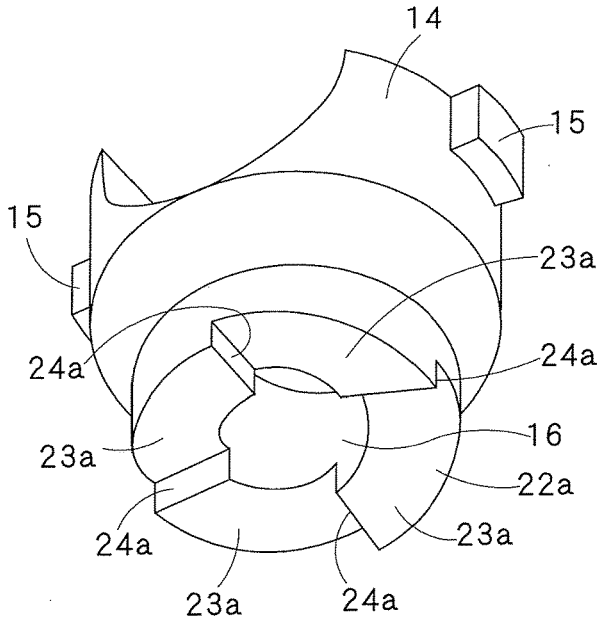
FIG. 4 is a perspective view of a fixing member as seen from the bottom.

With reference to FIG. 2, FIG. 4 and FIG. 5, between the fixing member 14 and the adjustment member 17, namely between the upper face of the adjustment member 17 and the lower face of the fixing member 14 in FIG. 2, a ratchet mechanism is disposed which allows the adjustment member 17 to rotate when the spiral rod 5 is rotated in a winding direction that winds the torsion spring 11 and prevents the adjustment member 17 from rotating when the spiral rod 5 is rotated in the opposite direction that unwinds the torsion spring.

In this embodiment, the fixing member 14 has four ratchet teeth 22*a* and the adjustment member 17 has four corresponding ratchet teeth 22*b*. Each ratchet tooth 22*a*,22*b* has a slant face 23*a*,23*b* which slants in the circumferential direction of the pipe 1 and a stepped portion 24*a*,24*b* at the end portion of the slant face. In a rest state (FIG. 3), the ratchet teeth 22*a*,22*b* engage one another, i.e., the slant faces 23*a* engage with the slant faces 23*b* and the stepped portions 24*a* engage with the stepped portions 24*b*.

When the adjustment member 17 is rotated counterclockwise in the direction of the arrow shown in FIG. 2, the slant faces 23*b* of the adjustment member 17 slide along the slant faces 23*a* of the fixing member 14. As the elevated parts of the slant faces 23*b* approach the elevated parts of the slant faces 23*a*, the adjustment member 17 is moved downwardly against the biasing force of the stopper spring 20. As the adjustment member 17 is further rotated in the winding direction, the stepped portions 24*b* slide over the stepped portions 24*a* of the fixing member 14 at which time the stopper spring 20 rapidly pulls the adjustment member 17 upwardly causing the slant faces 23*b* to abut the slant faces 23*a*. The rapid abutment of the ratchet teeth 22*a*,22*b* generates a "snap" or "click" sound indicating that the torsion spring 11, which rotates with the adjusting member, has rotated one increment in the winding direction. By repeating this operation, the torsion spring 11 can be wound to a predetermined pre-tension state by simply counting the number of snaps or clicks generated during rotation of the adjustment member 17. After each incremental rotation, the adjustment member 17 is prevented from rotating in the reverse direction that would unwind the torsion spring 11 due to engagement of the stepped portions 24*a*,24*b*.

In the described embodiment, the ratchet mechanism is disposed on the lower surface of the fixing member 14 and the upper surface of the adjustment member 17. The invention is not limited to this arrangement and, for example, the ratchet mechanism may be disposed on the circumferential side faces of the adjustment member and fixing member.

By the above structure, after incorporating the respective members into the pipe 1, and without withdrawing the spiral rod 5 out of the pipe, the adjustment member 17 can be rotated and the torsion spring 11 can be wound by exerting rotation by use of the second terminal 7 under such condition that the first terminal 6 of the spiral rod 5 is engaged with the adjustment member 17. Thus, the spiral balance manufacturers can provide window manufacturers with the spiral balance devices in such a condition that pre-tension is preliminarily applied by winding the spring with a predetermined number of rotations. At that time, at each time of rotation, the "snap" or "click" abutment sound is generated with the ratchet teeth 22*a*, 22*b*, whereby the number of rotations can be confirmed. If the spring is overly wound, the spiral rod 5 may be put in a free state by pulling the spiral rod 5 downward to disengage the first terminal 6 from the engagement projections 21 of the adjustment member 17. As a result, the spiral rod 5 and the coupling 3 can freely rotate, whereby the torsion spring 11 is released. Afterward, by elevating the spiral rod 5 to place the first terminal 6 into engagement with the engagement projections 21, the winding operation can be made again by rotating the spiral rod.

In the above examples, the present invention is applied to a sash window, but the present invention may be applied to other windows, sliding doors, and various apparatuses with opening or closing operation.

What is claimed is:

1. A spiral balance device, comprising:

a pipe having an upper end and a lower end;

a spiral rod having a first terminal housed in the pipe, a second terminal which projects from the lower end of the pipe, and a screw section extending in an axial direction between the first and second terminals;

a coupling rotatably disposed near the lower end of the pipe and having a slot through which extends the spiral rod;

a torsion spring having a lower end fixed to the coupling to rotate therewith and an upper end fixed near the upper end of the pipe;

a fixing member fixed within the upper end of the pipe;

an adjustment member rotatably disposed in the pipe below the fixing member and having an engagement projection engageable with the first terminal of the spiral rod; and a ratchet mechanism disposed between the fixing member and the adjustment member and which, relative to the fixing member, allows the adjustment member to rotate in a direction of winding the torsion spring and prevents the adjustment member from rotating in a direction of unwinding the torsion spring.

2. The spiral balance device according to claim 1; wherein the ratchet mechanism has ratchet teeth disposed on the lower face of the fixing member and the upper face of the adjustment member, each ratchet tooth having a slant face slanting in a circumferential direction of the pipe and a stepped portion positioned at one end of the slant face.

3. The spiral balance device according to claim 1; wherein the adjustment member has a projection extending through an axial hole at the center of the fixing member, and a stopper spring disposed around the projection for urging the adjustment member toward the fixing member side.

4. The spiral balance device according to claim 3; wherein the stopper spring is disposed between an enlarged-head section at the front end of the projection and an upper face of the fixing member.

5. A spiral balance device, comprising:

a pipe having an upper end and a lower end;

a spiral rod extending axially inside the pipe and having an upper end portion disposed in the pipe, a lower end portion projecting from the lower end of the pipe, and a screw section extending axially between the upper and lower end portions;

a coupling rotatably disposed inside the pipe near the lower end thereof and having a slot through which extends the screw section;

a torsion spring extending axially inside the pipe and having a lower end fixed to the coupling to rotate therewith and an upper end fixed near the upper end of the pipe;

a fixing member fixed within an upper end portion of the pipe;

an adjustment member rotatably disposed in the pipe below the fixing member and engageable with the upper end portion of the spiral rod so that rotation of the spiral rod effects rotation of the adjustment member; and a ratchet mechanism disposed between the fixing member and the adjustment member and which, relative to the fixing member, allows the adjustment member to rotate in a direction of winding the torsion spring and prevents the adjustment member from rotating in a direction of unwinding the torsion spring.

6. The spiral balance device according to claim 5; wherein the ratchet mechanism comprises ratchet teeth on the adjustment member in sliding engagement with ratchet teeth on the fixing member.

7. The spiral balance device according to claim 6; wherein each ratchet tooth has a slant face slanting in a circumferential direction of the pipe and a stepped portion at one end of the slant face.

8. The spiral balance device according to claim 7; including a stopper spring that biases the ratchet teeth of the adjustment member into engagement with the ratchet teeth of the fixing member so that rotation of the adjustment member in the direction of winding the torsion spring causes the slant faces of the adjustment member ratchet teeth to slide along the slant faces of the fixing member ratchet teeth to move the adjustment member downwardly against the bias of the stopper spring, and when the stepped portions of the adjustment member ratchet teeth slide over the stepped portions of the fixing member ratchet teeth, the adjustment member is biased upwardly by the stopper spring causing the slant faces of the adjustment member ratchet teeth to rapidly abut the slant faces of the fixing member ratchet teeth and generate an audible abutment sound.

9. The spiral balance device according to claim 8; wherein the adjustment member has a projection that extends upwardly through an opening at the center of the fixing member, the stopper spring being disposed around the projection.

10. The spiral balance device according to claim 9; wherein the projection has an enlarged-head section, and the stopper spring is interposed between the enlarged-head section and the fixing member.

11. The spiral balance device according to claim 6; including a stopper spring interposed between the adjustment member and the fixing member for biasing the ratchet teeth of the adjustment member into engagement with the ratchet teeth of the fixing member.

12. The spiral balance device according to claim 11; wherein the ratchet teeth are configured to move the adjustment member in a direction away from the fixing member in response to each predetermined increment of rotation of the adjustment member in the direction of winding the torsion spring and to allow the torsion spring to move the adjustment member into abutment with the fixing member after each increment of rotation to generate an audible abutment sound.

13. The spiral balance device according to claim 12; wherein each ratchet tooth has a slant face slanting in a circumferential direction of the pipe and a stepped portion at one end of the slant face.

14. The spiral balance device according to claim 11; wherein the adjustment member has a projection that extends upwardly through an opening at the center of the fixing member, the stopper spring being disposed around the projection.

15. The spiral balance device according to claim 14; wherein the projection has an enlarged-head section, and the stopper spring is interposed between the enlarged-head section and the fixing member.

* * * * *